US011045923B2

(12) United States Patent
Suri

(10) Patent No.: US 11,045,923 B2
(45) Date of Patent: Jun. 29, 2021

(54) VICE JAW ASSEMBLY

(71) Applicant: Muhammad Fareed Khan Suri, Sauk Rapids, MN (US)

(72) Inventor: Muhammad Fareed Khan Suri, Sauk Rapids, MN (US)

( * ) Notice: Subject to any disclaimer, the term of this patent is extended or adjusted under 35 U.S.C. 154(b) by 434 days.

(21) Appl. No.: 16/123,628

(22) Filed: Sep. 6, 2018

(65) Prior Publication Data

US 2020/0078906 A1 Mar. 12, 2020

(51) Int. Cl.
*B25B 1/24* (2006.01)
*B25B 1/10* (2006.01)

(52) U.S. Cl.
CPC ..... *B25B 1/241* (2013.01); *B25B 1/2463* (2013.01); *B25B 1/103* (2013.01); *B25B 1/2489* (2013.01)

(58) Field of Classification Search
CPC ..... B25B 1/24; B25B 1/241; B25B 1/2452; B25B 1/2457; B25B 1/2463; B25B 1/103; B25B 1/2405; B25B 1/18; B25B 5/16; B25B 5/163; B25B 11/00; B25B 11/02
USPC ..... 269/282, 43, 45, 271
See application file for complete search history.

(56) References Cited

U.S. PATENT DOCUMENTS 5,330,167 A * 7/1994 Plumb ..... B25B 1/06 269/153
5,711,515 A 1/1998 Nishimura
6,126,158 A 10/2000 Engibarov
2010/0164159 A1* 7/2010 Wurthele ..... B25B 1/103 269/242

FOREIGN PATENT DOCUMENTS

| | | |
|---|---|---|
| CN | 2014123144 | 1/2015 |
| JP | 5231832 | 7/2013 |
| KR | 101109862 | 1/2012 |
| WO | WO206150536 | 9/2016 |

* cited by examiner

*Primary Examiner* — Lee D Wilson
*Assistant Examiner* — Seahee Hong

(57) ABSTRACT

A vice jaw assembly includes a unitary body that has a top side, a bottom side, a front side, a rear side, a first lateral side and a second lateral side. The top side has an elongated channel therein spaced from the front side and the rear side and defined by a bottom wall, a first lateral wall and a second lateral wall. The bottom wall has a plurality of first wells extending therein each engageable with a male coupler. The bottom wall has a plurality of second wells extending therein each engageable with a male coupler. Each of the second wells is centered within one of a plurality of annular depressions. Each of the annular depressions extends into the bottom wall and has a circular shape. The annular depressions each extend into the first lateral wall such that the lateral wall includes a plurality of semi-cylindrical grooves therein.

9 Claims, 5 Drawing Sheets

VICE JAW ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to vice mountable jaw devices and more particularly pertains to a new vice mountable jaw device for allowing differently structured coupling members to be simultaneously attached to a machine vice.

BRIEF SUMMARY OF THE INVENTION

An embodiment of the disclosure meets the needs presented above by generally comprising a unitary body that has a top side, a bottom side, a front side, a rear side, a first lateral side and a second lateral side. The unitary body is elongated from the first lateral side to the second lateral side. The top side has an elongated channel therein that is spaced from the front side and the rear side. The channel is defined by a bottom wall, a first lateral wall and a second lateral wall. The first lateral wall includes the front side and the second lateral wall includes the rear side. The bottom wall has a plurality of first wells extending therein. The first wells are configured to receive and releasably engage a male coupler. The first wells are aligned with each other and are equally spaced from the first and second lateral walls. The bottom wall has a plurality of second wells extending therein. The second wells are configured to receive and releasably engage a male coupler. Each of the second wells is centered within one of a plurality of annular depressions. Each of the annular depressions extends into the bottom wall and has a circular shape. The annular depressions each extend into the first lateral wall such that the lateral wall includes a plurality of semi-cylindrical grooves therein.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
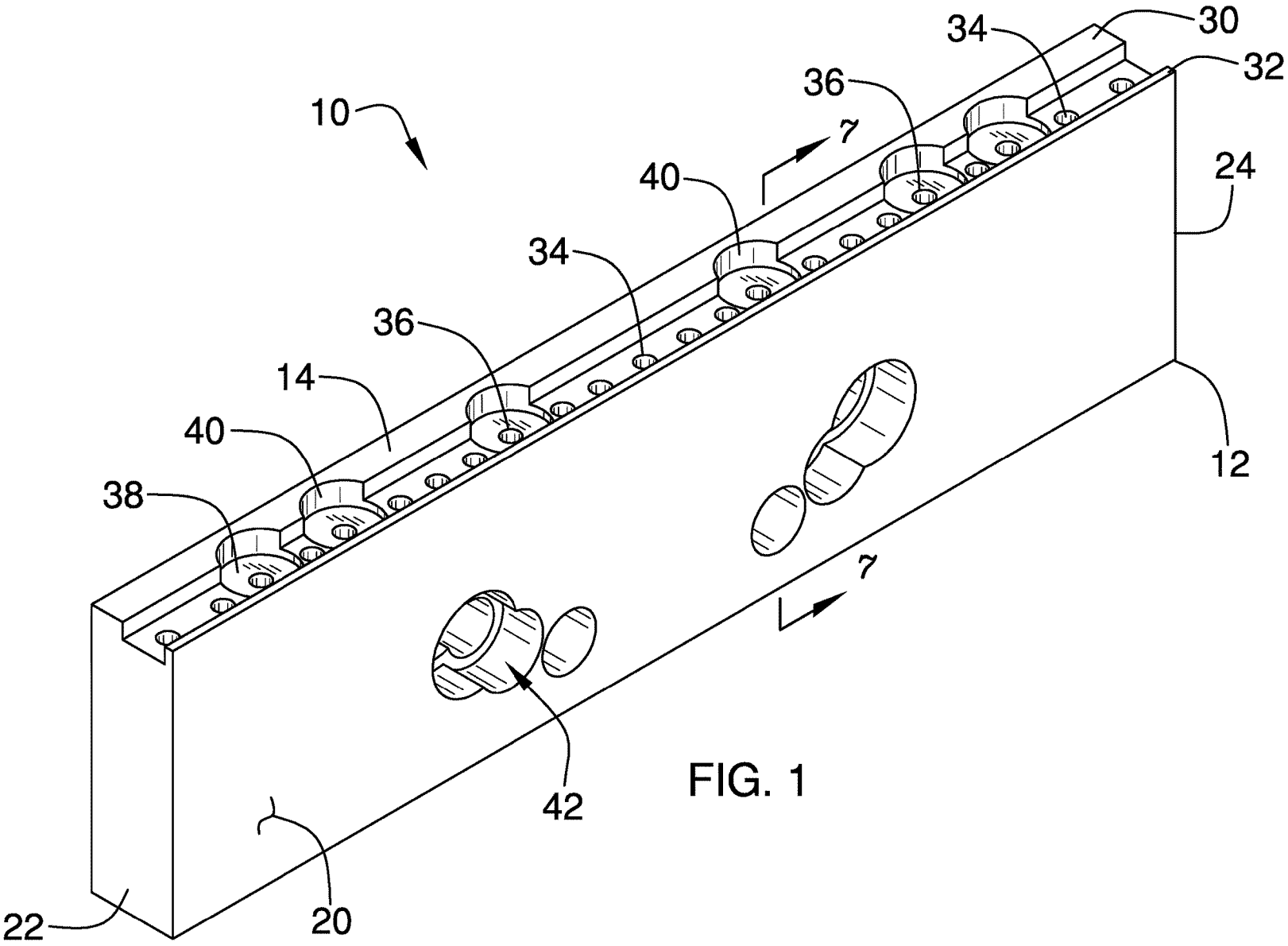
FIG. 1 is a rear isometric view of a vice jaw assembly according to an embodiment of the disclosure.
Figure 2:
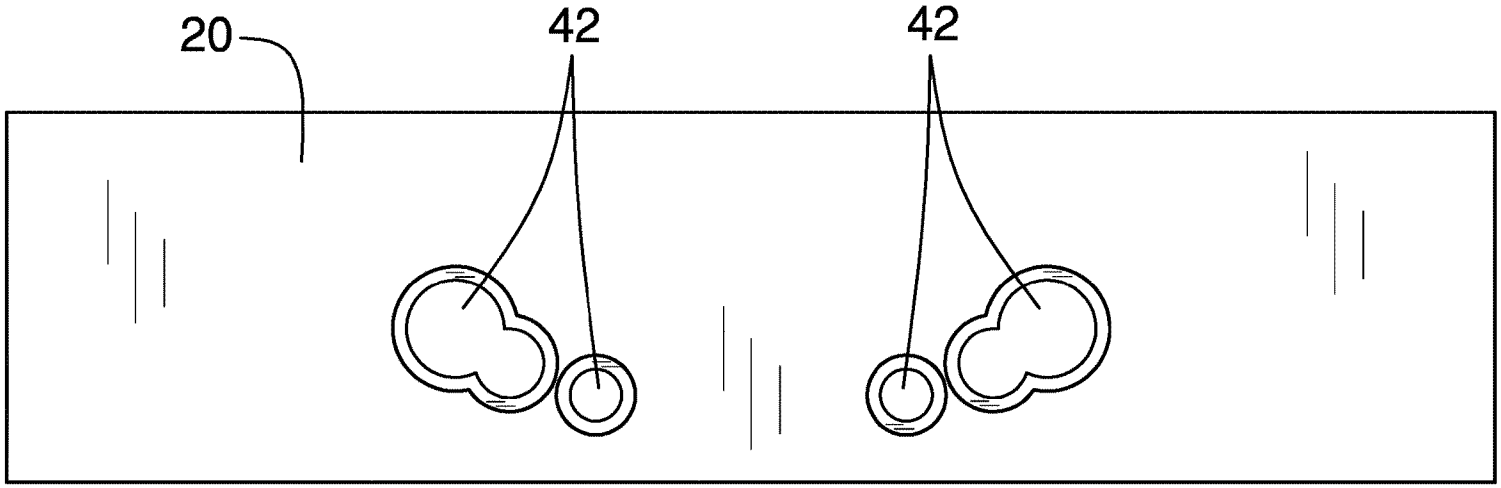
FIG. 2 is a rear view of an embodiment of the disclosure.
Figure 3:
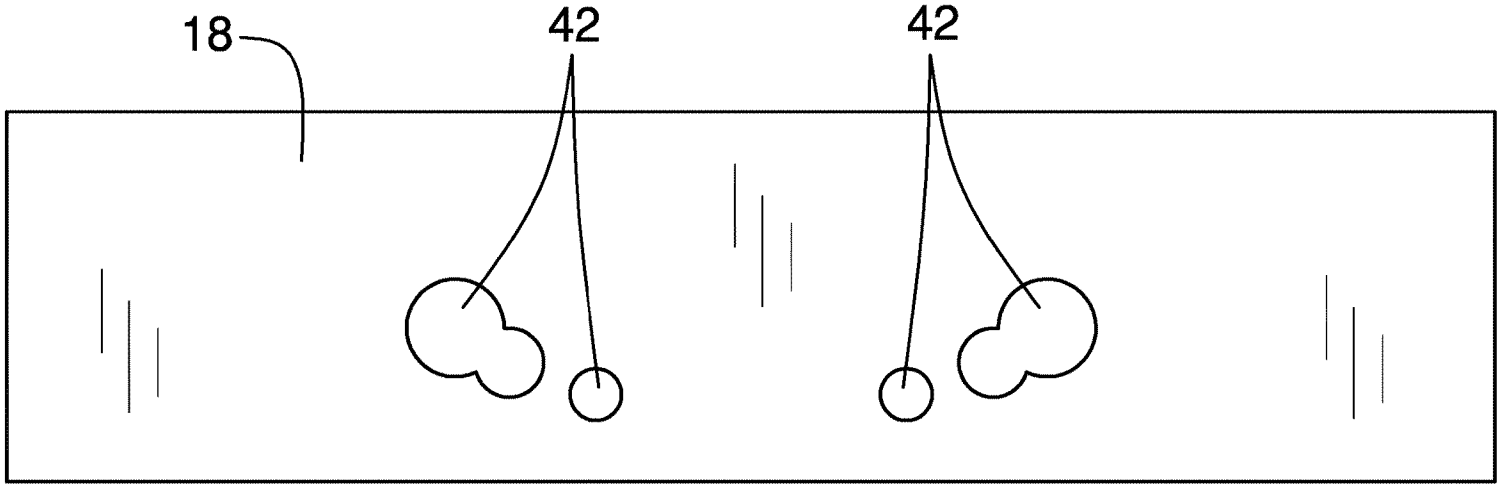
FIG. 3 is a front view of an embodiment of the disclosure.
Figure 7:
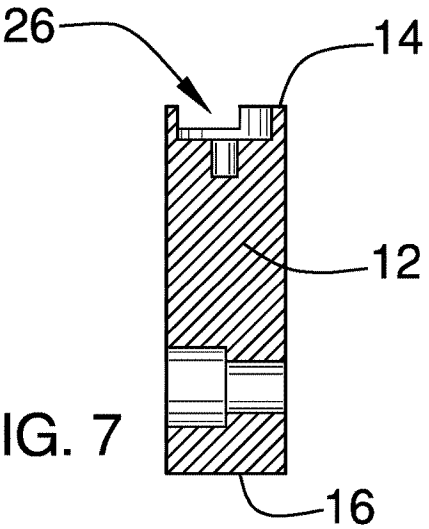
FIG. 7 is a cross-sectional view of an embodiment of the disclosure taken along line 7-7 of FIG. 1.
Figure 4:
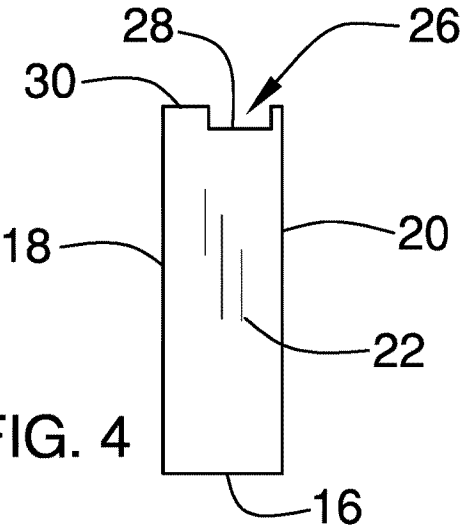
FIG. 4 is a right side view of an embodiment of the disclosure.
Figure 5:
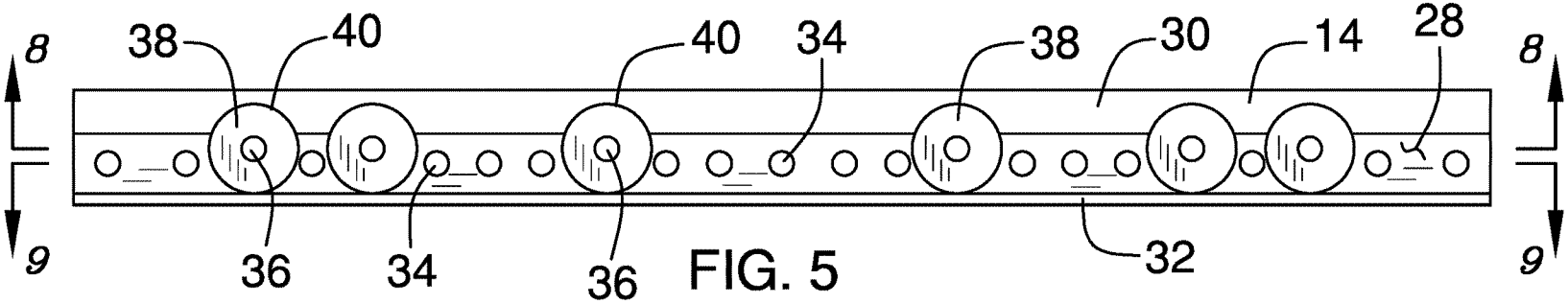
FIG. 5 is a top view of an embodiment of the disclosure.
Figure 6:
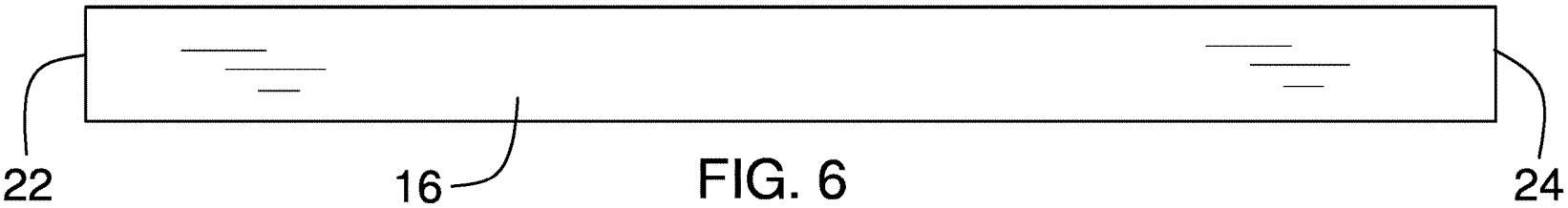
FIG. 6 is a bottom view of an embodiment of the disclosure.
Figure 8:
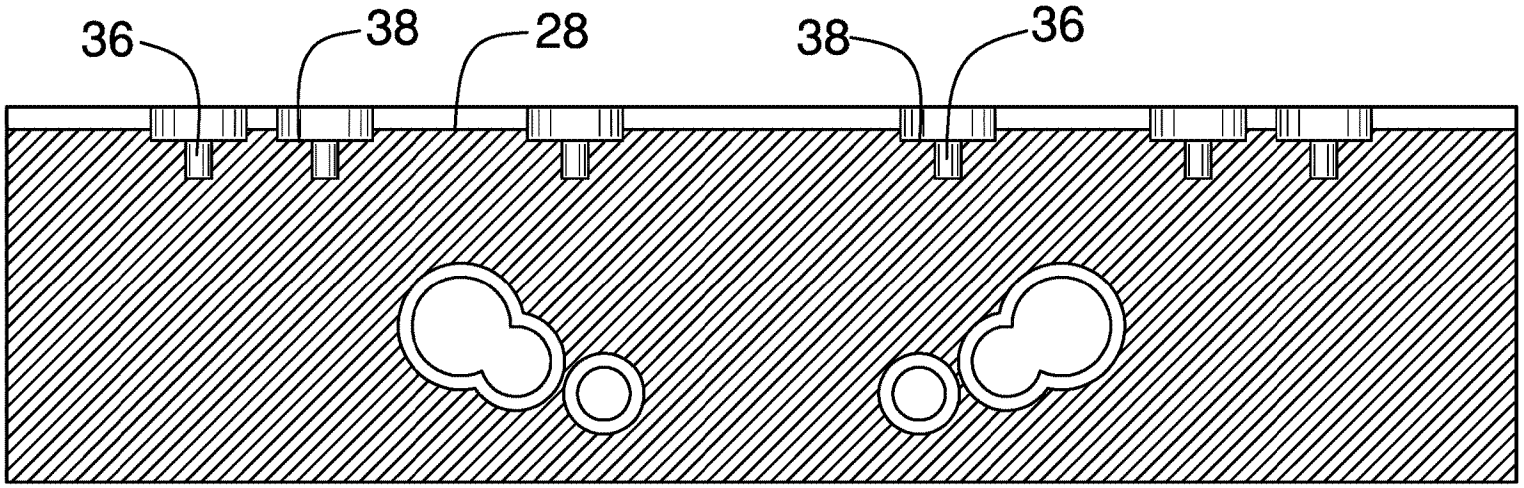
FIG. 8 is a cross-sectional view of an embodiment of the disclosure taken along line 8-8 of FIG. 5.

With reference now to the drawings, and in particular to FIGS. 1 through 10 thereof, a new vice mountable jaw device embodying the principles and concepts of an embodiment of the disclosure and generally designated by the reference numeral 10 will be described.

As best illustrated in FIGS. 1 through 10, the vice jaw assembly 10 generally comprises a unitary body 12 that has a top side 14, a bottom side 16, a front side 18, a rear side 20, a first lateral side 22 and a second lateral side 24. The unitary body 12 is elongated from the first lateral side 22 to the second lateral side 24. The unitary body 12 is typically comprised of a rigid material such as steel and has a length from the first lateral side 22 to the second lateral side 24 between 5.0 inches and 12.0 inches and a width from the front side 18 to rear side 20 between 1.0 inches and 1.75 inches. A height from the bottom side 16 to the top side 14 may be between 1.5 inches and 3.0 inches.

The top side 14 has an elongated channel 26 therein that is spaced from the front side 18 and the rear side 20. The channel 26 is defined by a bottom wall 28, a first lateral wall 30 and a second lateral wall 32 wherein the first lateral wall 30 includes the front side 18 and the second lateral wall 32 includes the rear side 20. The first lateral wall 30 may have a width from the channel 26 to the front side 18 that is greater than a width of the second lateral wall 32 from the channel 26 to the rear side 20. The channel 26 extends through the first 22 and second 24 lateral sides.

Figure 9:
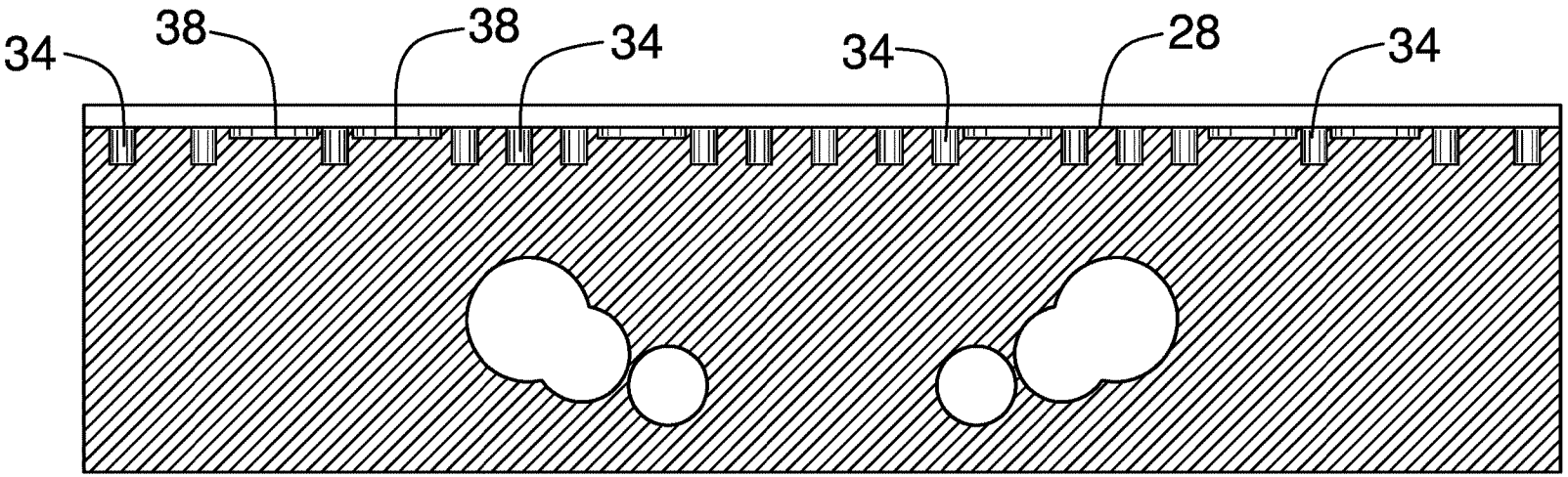
FIG. 9 is a cross-sectional view of an embodiment of the disclosure taken along line 9-9 of FIG. 5.
Figure 10:
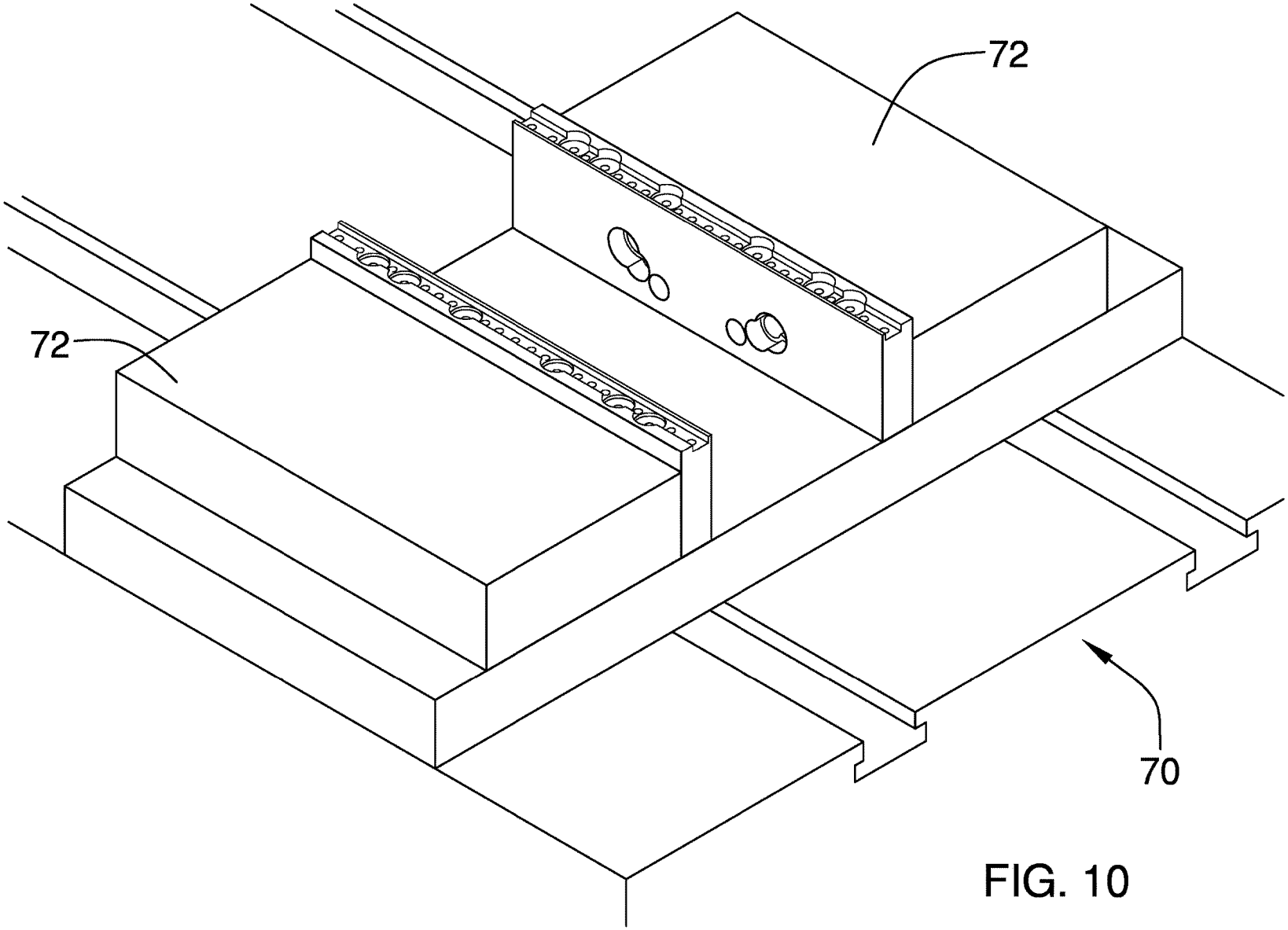
FIG. 10 is an in-use, top isometric view of an embodiment of the disclosure.

The bottom wall 28 has a plurality of first wells 34 extending therein. The first wells 34 are configured to receive and releasably engage a male coupler. The male coupler is typically a threaded rod that extends through a grip. These types of grips are sold, for example, under the name Talon Grips and are widely available for purchase from numerous vendors. This type of grip, which typically has a rectangular shape, is configured to grip straight edged materials that are to be milled by a computer numerical control (CNC) milling tool 70. The grip is positioned in the channel 26 and the male coupler extends into one of the first wells 30 and threadably couples to the unitary body 12. The grip extends above the top side 14 to engage the straight edge of the material to be milled. The first wells 34 are each aligned with each other and are equally spaced from the first 30 and second 32 lateral walls. An outer opening of the first wells 34 is coplanar with the bottom wall 28 as is shown in FIG. 9 and the surfaces of the first 30 and second 32 walls most adjacent to the first wells 34 are planar.

The bottom wall 28 also has a plurality of second wells 36 extending therein. The second wells 36 are also configured to receive and releasably engage a male coupler in a same manner as the first wells 34. The second wells 36 are aligned with each other and are positioned nearer to the first lateral wall 30 than the second lateral wall 32. However, each of the second wells 36 is centered within one of a plurality of annular depressions 38. Each of the annular depressions 38 extends into the bottom wall 28 as shown in FIG. 9 and has a circular shape. The annular depressions 38 each extend into the first lateral wall 30 such that the lateral wall 30 includes a plurality of semi-cylindrical grooves 40 therein. The second lateral wall 32, unlike the first lateral wall 30, is free of grooves 40 and is planar from the first lateral side 22 to the second lateral side 24. More specifically, the openings for the second wells 36 are positioned below a plane of the bottom wall 28 and instead are coplanar with a surface of the corresponding annular depression 38.

The second wells 36 and their accompanying annular depression 38 are configured to receive cylindrical shaped grips. These types of grips may, for example, be found easily under the trade name VersaGrips. These types of grips may include annular depressions within their cylindrical shaped outer walls that allow for gripping on rounded edges of materials to be milled.

The front side 18 has a plurality of mounting apertures 42 extending therein and through the rear side 20. The mounting apertures 42 are spaced from the channel 26 and the first 34 and second 36 wells. The mounting apertures 42 allow fasteners to be extended through the unitary body 12 and into a vice 72 of a milling machine 70. Typically, a pair of the unitary bodies 12 are utilized and positioned opposite of each other such that the vice 72 moves the unitary bodies 12 toward each other and the grips mounted thereon engage the piece of material to be milled.

In use, the unitary body 12 is used as a conventional gripping jaw mount for a CNC milling machine 70. However, the dual inclusion of first wells 34 having planar surfaces positioned on opposite sides of the first wells 34 and second wells 36 including annular depressions 38 and one adjacent wall having an annular groove 40 therein, allows a user of the assembly 10 to use different types of grips without having to change the jaw mount, that is the unitary body 12, as is the conventional practice. This allows a user of the assembly to retain fewer unitary bodies 12 and to increase productivity. Additionally, a pair of unitary bodies 12 may be used with all shapes of materials to be milled including those materials having non-uniform structures such as one straight edge and one round edge.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A gripping jaw mount assembly configured for receiving gripping members for holding articles to be milled, said assembly comprising:

a unitary body having a top side, a bottom side, a front side, a rear side, a first lateral side and a second lateral side, said unitary body being elongated from said first lateral side to said second lateral side;

said top side having an elongated channel therein, said channel being spaced from said front side and said rear side, said channel being defined by a bottom wall, a first lateral wall and a second lateral wall, said first lateral wall including said front side, said second lateral wall including said rear side;

said bottom wall having a plurality of first wells extending therein, said first wells being configured to receive and releasably engage a male coupler, said first wells being aligned with each other and being equally spaced from said first and second lateral walls;

said bottom wall having a plurality of second wells extending therein, said second wells being configured to receive and releasably engage another male coupler; and each of said second wells being centered within one of a plurality of annular depressions, each of said annular depressions extending into said bottom wall and having a circular shape, said annular depressions each extending into said first lateral wall such that said first lateral wall includes a plurality of grooves therein.

2. The gripping jaw mount assembly according to claim 1, wherein said first lateral wall has a width from said channel to said front side being greater than a width of said second lateral wall from said channel to said rear side.

3. The gripping jaw mount assembly according to claim 2, wherein said channel extends through said first and second lateral sides.

4. The gripping jaw mount assembly according to claim 1, wherein said second wells are aligned with each other and being positioned nearer to said first lateral wall than said second lateral wall.

5. The gripping jaw mount assembly according to claim 4, wherein said second lateral wall is free of grooves and being planar from said first lateral side to said second lateral side.

6. The gripping jaw mount assembly according to claim 1, wherein said second lateral wall is free of grooves and being planar from said first lateral side to said second lateral side.

7. The gripping jaw mount assembly according to claim 1, wherein said front side has a plurality of mounting apertures extending therein and through said rear side.

8. The gripping jaw mount assembly according to claim 7, wherein said mounting apertures are spaced from said channel and said first and second wells.

9. A gripping jaw mount assembly configured for receiving gripping members for holding articles to be milled, said assembly comprising:

a unitary body having a top side, a bottom side, a front side, a rear side, a first lateral side and a second lateral side, said unitary body being elongated from said first lateral side to said second lateral side;

said top side having an elongated channel therein, said channel being spaced from said front side and said rear side, said channel being defined by a bottom wall, a first lateral wall and a second lateral wall, said first lateral wall including said front side, said second lateral wall including said rear side, said first lateral wall having a width from said channel to said front side being greater than a width of said second lateral wall from said channel to said rear side, said channel extending through said first and second lateral sides;

said bottom wall having a plurality of first wells extending therein, said first wells being configured to receive and releasably engage a male coupler, said first wells each being aligned with each other, said first wells being equally spaced from said first and second lateral walls;

said bottom wall having a plurality of second wells extending therein, said second wells being configured to receive and releasably engage another male coupler, said second wells being aligned with each other and being positioned nearer to said first lateral wall than said second lateral wall;

each of said second wells being centered within one of a plurality of annular depressions, each of said annular depressions extending into said bottom wall and having a circular shape, said annular depressions each extending into said first lateral wall such that said first lateral wall includes a plurality of grooves therein, said second lateral wall being free of grooves and being planar from said first lateral side to said second lateral side; and said front side having a plurality of mounting apertures extending therein and through said rear side, said mounting apertures being spaced from said channel and said first and second wells.

* * * * *